US006644250B1

(12) United States Patent
Kantola et al.

(10) Patent No.: US 6,644,250 B1
(45) **Date of Patent: *Nov. 11, 2003**

(54) ENGINE OILING SYSTEM AND AN OIL SYSTEM DISTRIBUTION MANIFOLD, AND METHOD OF USE

(75) Inventors: James C. Kantola, Waukegan, IL (US); Richard P. Kolb, Prairieview, IL (US); David J. Hartke, Gurnee, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 305 days.

This patent is subject to a terminal disclaimer.

(21) Appl. No.: 09/670,730

(22) Filed: Sep. 27, 2000

(51) Int. Cl.[7] ..... F02B 33/04

(52) U.S. Cl. ..... 123/73 AD; 123/196 R; 184/6.8

(58) Field of Search ..... 123/73 AD, 196 R, 123/196 M, 196 W; 184/6.8

(56) References Cited

U.S. PATENT DOCUMENTS 1,643,674 A 9/1927 Miller
4,471,727 A 9/1984 Hatsudoki et al.
5,501,190 A 3/1996 Okubo et al.
5,787,854 A 8/1998 Uhlig

FOREIGN PATENT DOCUMENTS

EP 0 556 437 A1 8/1993

*Primary Examiner*—Noah P. Kamen
(74) *Attorney, Agent, or Firm*—Ziolkowski Patent Solutions Group, LLC

(57) ABSTRACT

The present invention includes a distribution manifold for evenly distributing engine oil to the cylinders of an internal combustion engine, as well as, directing oil and purging any air accompanying the oil through the fuel system of an internal combustion engine. The manifold includes a plurality of cylinder oiling outlet housings, each having a number of cylinder oiling valves corresponding to the number of cylinders in an internal combustion engine. The distribution manifold has a centrally-located dome in fluid communication with the cylinder oiling outlet housings. Extending from the apex of the dome is a fuel system outlet housing also having an oiling valve to regulate the flow of oil to the fuel system. A notch extends along the upper interior surface of the centrally-located dome in fluid communication with the fuel system outlet housing. The notch is positioned so that air that rises to the top of the centrally-located dome can be purged through the fuel system oiling outlet valve to a fuel separator in the fuel system of the internal combustion engine.

32 Claims, 7 Drawing Sheets

10

12a
14
12
14
12b
16
20
15
36
15
30
18b
18
18a
22
28
34
32
26
24

ENGINE OILING SYSTEM AND AN OIL SYSTEM DISTRIBUTION MANIFOLD, AND METHOD OF USE

BACKGROUND OF THE INVENTION

The present invention relates generally to oiling systems for internal combustion engines, and more specifically, to a manifold for distributing engine oil in a two-stroke internal combustion engine.

Typically, two-stroke outboard marine engines did not have a separate oiling system. That is, these prior art engines required pre-mixing lubricant and fuel so that the lubricant dissolves in the fuel to lubricate the engine. This required consistent, accurate measuring and agitation of the mixture. There are many disadvantages to the prior art system of pre-mixing lubricant and fuel. For example, since various two-stroke engines require different mix concentrations, many outboard marine engine owners who also own other two-stroke engine equipment, such as various lawn and garden equipment and ATV's, may store several different concentrations of oil/fuel mixture. This is not only an aggravation to the owner, but is also problematic if the containers become mixed up and the owner uses the wrong concentration for a particular two-stroke engine. While this is not catastrophic, if run over time with the wrong concentration, a two-stroke engine wears excessively.

The present invention is for use in a unique lubrication system for two-stroke engines. Such a lubrication system must not only provide lubrication to each cylinder of the engine, it must also provide lubrication to the fuel system to properly lubricate the fuel metering and injection system. As is well known, air entrained in the oil, can hinder a properly operating lubrication system. It is therefore desirable to remove any air from the oil, while preventing any such air in the oil system from being fed to the cylinders of the engine. As is known, air in such a system can prevent oil flow, especially where check valves are used, resulting in a phenomena known as "air lock." If an oil passage becomes air locked, the operator would have no way of knowing that the affected cylinder is not receiving sufficient oil, and continued operation of the engine will result in severe damage to that particular cylinder.

It would therefore be desirable to have a distribution manifold that can evenly distribute oil to a number of cylinders of an internal combustion engine and purge air from the oil system while providing oil to the fuel system components. It would also be advantageous to be able to use a single distribution manifold with engines of differing number of cylinders.

SUMMARY OF THE INVENTION

The present invention provides a distribution manifold for distributing engine oil to each cylinder of an internal combustion engine and to the fuel system as well as purges air from the oil system. The present invention also provides a design for a distribution manifold capable of being used with either a four cylinder or six cylinder internal combustion engine. Further, the present invention provides an oiling system for a two-stroke outboard marine engine utilizing a manifold as disclosed herein, as well as, a solenoid mounted to an oil system housing to control engine oil flow to the distribution manifold. All of which overcome the aforementioned drawbacks.

In accordance with one aspect of the invention, a distribution manifold for use with a two-stroke internal combustion engine is provided. The distribution manifold includes a number of cylinder oiling outlets to provide oil to each cylinder of the two-stroke internal combustion engine. The manifold also includes a fuel system oiling outlet extending from a centrally-located dome at a height axially above the other outlet housings and is in fluid communication to provide regulated oil flow to the fuel system. A notch extends along a upper portion of the interior surface of the centrally-located dome to purge air from the oil system through the fuel system.

Another aspect of the present invention is to provide a distribution manifold having a centrally-located chamber. The centrally-located chamber has a plurality of cylinder outlet ports and a fuel system outlet port. The fuel system outlet port is positioned at an elevation higher than the cylinder outlet ports. Positioning of the fuel system outlet port at an elevation higher than the cylinder outlet port allows air trapped in the centrally-located chamber to rise to the top of the chamber to be purged through the fuel system downstream.

It is yet another aspect of the invention, to provide a design for an oil distribution manifold that may be utilized with a four cylinder as well as a six cylinder internal combustion engine. In the six cylinder configuration, the intake manifold has six cylinder outlet ports and a separate fuel system outlet port. The oil cylinder outlet ports each include an oiling outlet valve that regulates the flow of pressurized engine oil to each of the cylinders. To accommodate a four cylinder internal combustion engine two oiling outlet valves are removed from two of the cylinder outlet housings to prevent the flow of oil to the engine cylinders. Removing the two oiling outlet valves fluidly isolates these housings from the centrally-located chamber.

It is still a further object of the present invention to provide an oiling system for a two-stroke outboard marine engine. The oil system has a housing having an oil inlet and an oil outlet. A distribution manifold is mounted to the housing and is in fluid communication with the oil outlet of the housing. The manifold has a plurality of cylinder oiling outlets as well as a fuel system oiling outlet. A solenoid is also mounted to the oil system housing to control the flow of engine oil from the oil pump to the manifold and to each cylinder of the fuel system of the internal combustion engine.

The invention also includes a method of using an oil distribution manifold in engines having differing number of cylinders. The method includes molding a distribution manifold with N cylinder oiling outlet housings and a centrally-located oil chamber. A number of passages are molded into the cylinder oiling outlet housings to communicate with the centrally-located oil chamber. The number of passages is equal to N if a number of cylinders of an engine is equal to N, and the number of passages is equal to M if the number of cylinders is equal to M, where M is less than N. In this manner, the same basic structure of the manifold can be used for engines having different number of cylinders.

The invention also includes a method of bleeding air from an oil system of an internal combustion engine that includes providing an oil outlet port for each cylinder of an engine and an oil outlet port for a fuel system of the engine, and positioning the outlet port for the fuel system at a higher elevation than each of the oil outlet ports for each cylinder. The outlet port for the fuel system is connected to a fuel separator in the fuel system. Thus, air in the oil system is allowed to bleed through the outlet port for the fuel system and is purged through the fuel separator, thereby removing air from the oil system.

Various other features, objects and advantages of the present invention will be made apparent from the following detailed description and the drawings.

BRIEF DESCRIPTION OF THE DRAWINGS

The drawings illustrate one preferred embodiment presently contemplated for carrying out the invention.

In the drawings.

DETAILED DESCRIPTION OF THE PREFERRED EMBODIMENT

The operating environment of the present invention herein is described with respect to two cycle outboard marine engine. However, it will be appreciated by those of ordinary skill in the art that the present invention is equally applicable for use with other types of internal combustion engines, such as diesel engines, using a distribution manifold for distributing engine oil to a plurality of cylinders and a fuel system.

Figure 1:
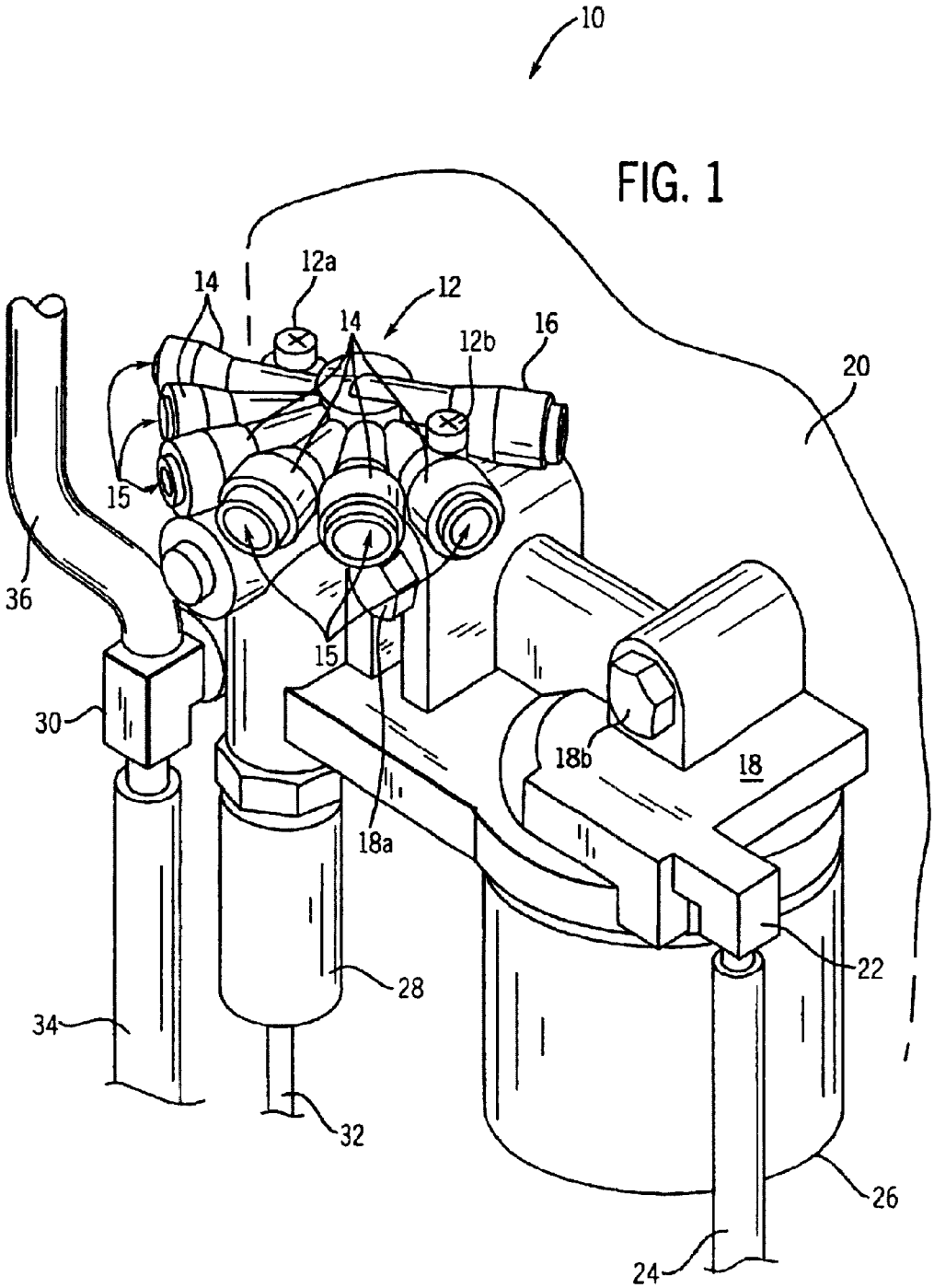
FIG. 1 is a perspective view of an oiling system for a two-stroke outboard marine engine.

Referring to FIG. 1, an oiling system 10 includes a distribution manifold 12 having a plurality of cylinder outlet housings 14 for each cylinder of a two-stroke internal combustion engine, such as those used for outboard marine engines. In this embodiment, distribution manifold 12 has six outlets 15, one for each cylinder of a six cylinder engine and a fuel system oiling outlet housing 16. The manifold 12 is mounted to an oil system housing 18 with mounting bolts 12*a,* 12*b.* The oil system housing 18 is mounted to the engine 20 with mounting bolts 18*a,* 18*b.* Oil is introduced into the oil system housing 18 in oil inlet 22 from oil supply line 24, and is internally routed to a replaceable oil filter 26. The oiling system housing 18 includes a solenoid that controls the flow of oil from the oil filter 26 to either the distribution manifold 12, or an oil outlet 30. The solenoid is controlled by power supplied from an ECU (not shown). The oil outlet 30 includes a return line 34 and a vent line 36. The oiling system housing 18 also includes an oil pressure switch 28 that receives power from the ECU on wire 32 and returns an oil pressure indicative signal to the ECU.

Figure 2:
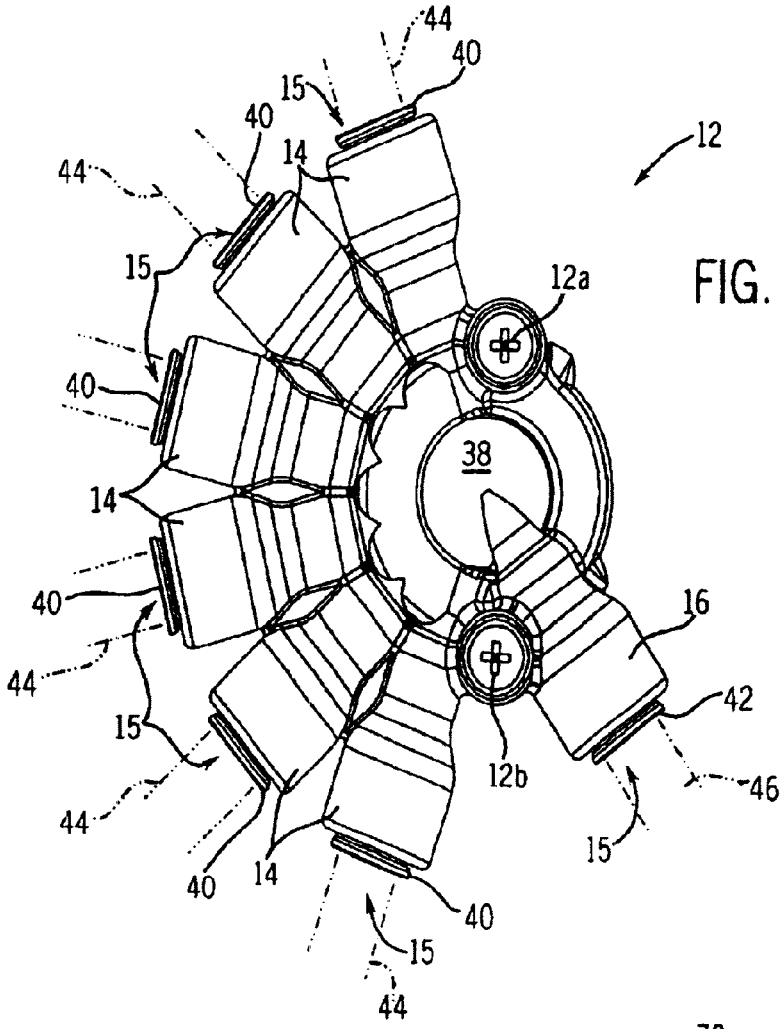
FIG. 2 is a top view of a distribution manifold used in the oiling system of FIG. 1.

FIG. 2 shows a top view of the distribution manifold 12. The cylinder outlet housings 14 are angled equidistantly about a centrally-located dome 38, preferably, at an angle of incidence of 28 degrees. The cylinder outlet housings 14, as well as the fuel system oiling outlet housing 16, each have an outlet 15 containing a push-to-connect fitting 40, 42, which will be described in detail with reference to FIG. 7. The push-to-connect fittings 40 for the cylinder outlet housings 14 retain a hose 44 in fluid communication with each cylinder of the internal combustion engine. The push-to-connect fitting 42 for the fuel system oiling outlet housing 16 also retains a hose 46 in fluid communication with a fuel separator (not shown) of the fuel system. As will be further described with reference to FIG. 7, the push-to-connect fittings 40, 42 are designed to prevent leakage, allow easy coupling of the hoses 44, 46, lock the hoses 44, 46 to the manifold outlets 15, 16, and allow easy decoupling of the hoses 44, 46 when needed.

Figure 3:
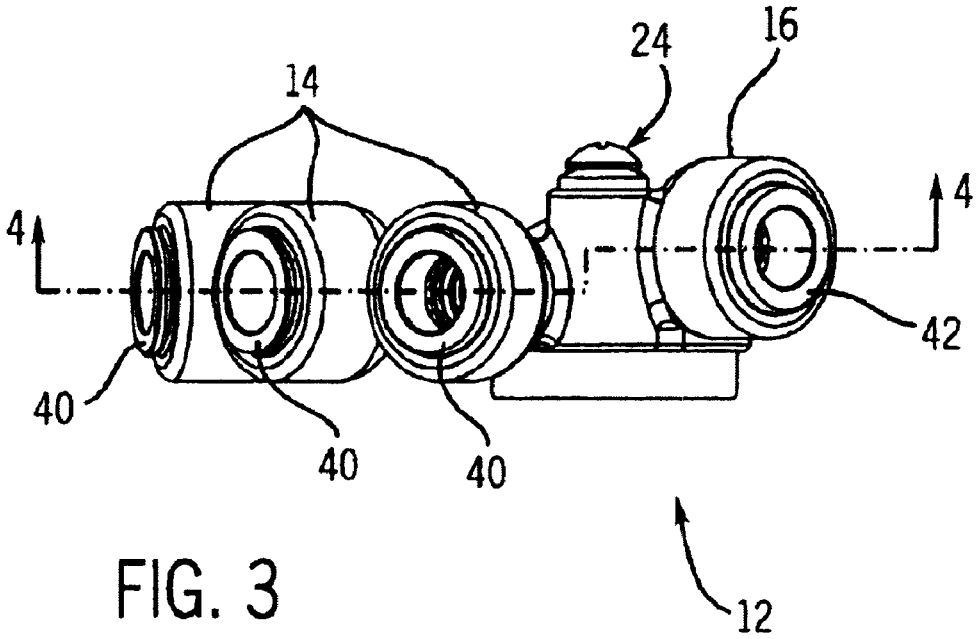
FIG. 3 is a front elevation view of the distribution manifold as shown in FIG. 1.

Referring now to FIG. 3, the fuel system outlet housing 16 is shown preferably positioned at a higher elevation than the cylinder outlet housings 14 to purge air from the distribution manifold 12 and the oiling system 10. The positioning of the fuel system oiling outlet housing 16 above the cylinder outlet housings 14 allows air that accumulates in dome 24 to purge through the fuel system oiling outlet housing 16 to the fuel separator where it is vented to the atmosphere. As shown the cylinder outlet housings 14 share a plane that is significantly below the plane of the fuel system oiling outlet housing 16.

Figure 4:
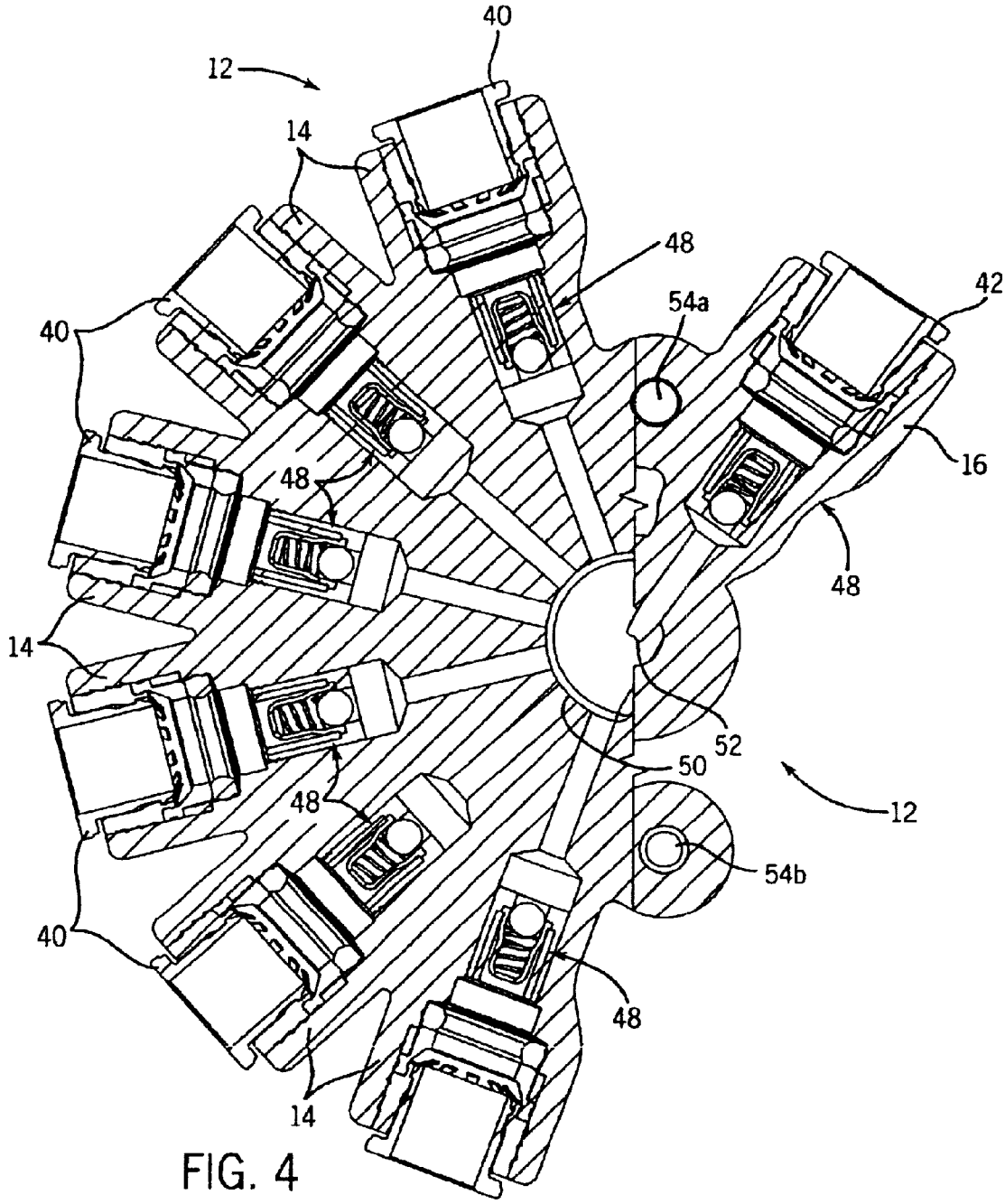
FIG. 4 is a cross-section top view of the distribution manifold of FIG. 3 taken along line 4—4 of FIG. 3.
Figure 6:
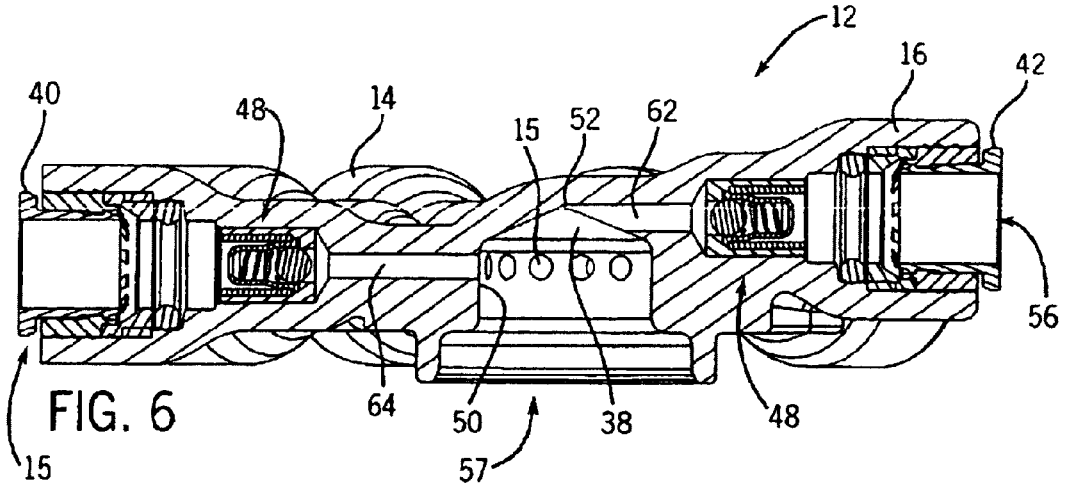
FIG. 6 is a cross-sectional side view of the distribution manifold taken along line 6—6 of FIG. 5.

An enlarged, cross-sectional view of the distribution manifold 12 of the oiling system 10 is shown in FIG. 4. The cylinder outlet housings 14 and the fuel system oiling outlet housing 16 each include an oiling check valve 48 that regulates the flow of oil from the centrally-located dome 38 to the cylinders and fuel system of the internal combustion engine, respectively. As best shown in FIG. 4 and FIG. 6, the cylinder outlet housings 14 extend from a side edge 50 of the centrally-located dome 38 whereas the fuel system oiling outlet housing 16 extends from an apex 52 of the centrally-located dome 38. Referring back to FIG. 4, two mounting bores 54*a,* 54*b* are provided in manifold 12 to receive mounting bolts 12*a,* 12*b,* FIG. 1, to secure the distribution manifold 12 to the oil system housing 18.

Figure 5:
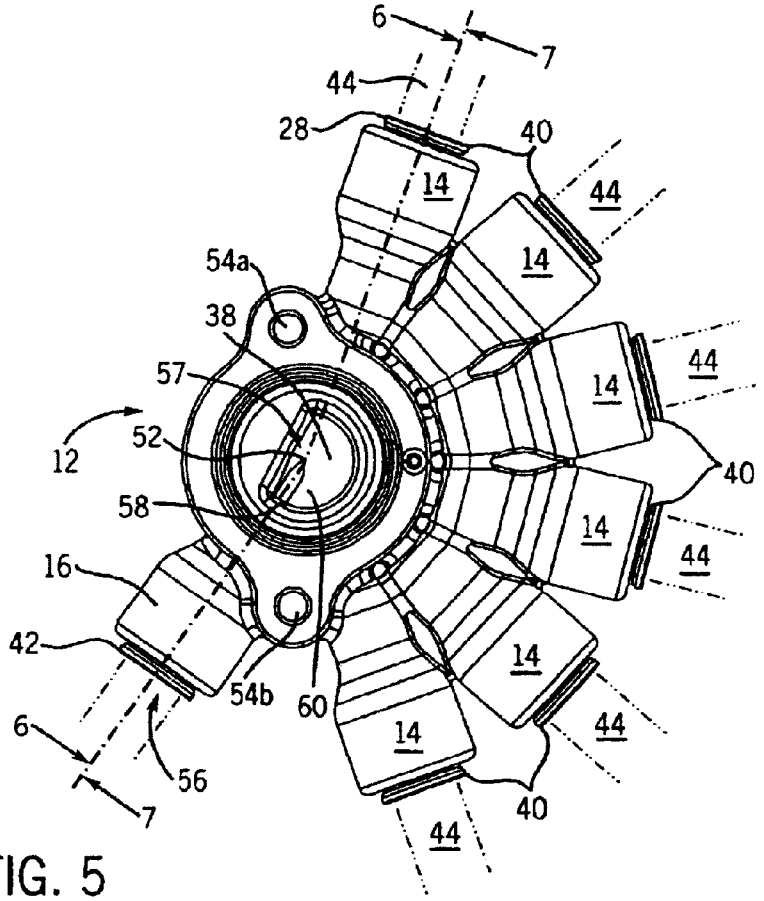
FIG. 5 is a bottom view of the distribution manifold shown in FIG. 2.

FIG. 5 is a bottom view of the distribution manifold 12 of the oiling system 10 showing an oil inlet 57 into the manifold 12. A bore 56 of the fuel system oiling outlet housing 16 extends inward to a notch 58 that extends along an upper interior surface 60 of the centrally-located dome 38. The notch 58 therefore is in fluid communication with the fuel system oiling outlet housing 16. The position of the notch 58 along the upper interior surface 60 of the centrally-located dome 38 allows for oil, as well as any air in the oil system, to be transported to the fuel system outlet housing 16 since the notch 58 is at the highest point of the dome 38. The oil inlet 57 is D-shaped to concentrate oil to the outlets 14, 16.

FIG. 6 is a cross-section of the manifold 12 showing the positioning of the fuel system oiling outlet housing 16 relative to the position of the cylinder outlet housings 14. As shown, the bore 56 of the fuel system oiling outlet housing 16 extends to the apex 52 of the centrally-located dome 38 through a passage 62. Each cylinder outlet housing 14 includes an oiling check valve 48 between each cylinder outlet port 15 and oil passage 64 in fluid communication with the centrally-located dome 38.

Figure 7:
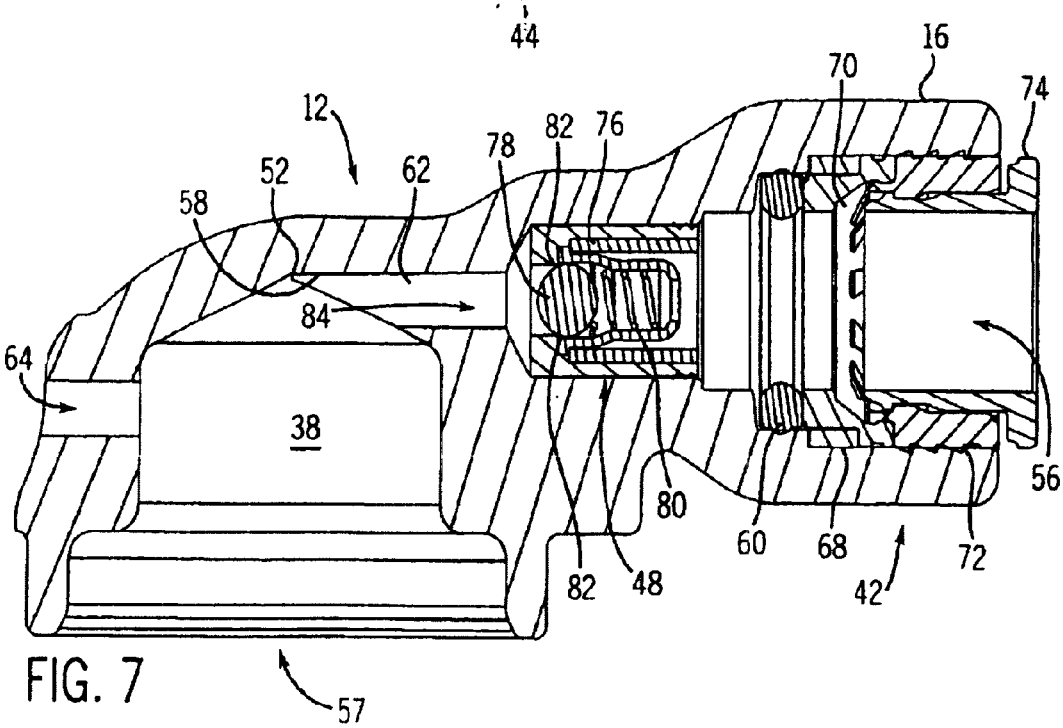
FIG. 7 is an enlarged view of the fuel system oiling outlet housing as shown in FIG. 5 taken along line 7—7 of FIG. 5.

FIG. 7 is a cross-sectional enlarged view of the fuel system oiling outlet housing 16 and a portion of the manifold 12. The fuel system oiling outlet housing 16 includes a push-to-connect fitting 42 and an oiling check valve 48 therein. The passage 62 extends laterally from the apex 52 of the centrally-located dome 38. In this manner, any air entering the oil inlet 57 will rise to the apex 52 and depart the oil system along notch 58, through passage 62 and exit through bore 56.

The push-to-connect fittings 40, 42 include a seal 66 that prevents leakage between the housing 16 and the push-to-connect fittings 40, 42. A ring sleeve 68 supports an internal gripping ring 70. The gripping ring 70 positively clamps a hose in position in the housings 14, 16. The push-to-connect fittings 40, 42 also include a barbed retaining sleeve 72 to hold the push-to-connect fittings 40, 42 securely within the housings 14, 16. The push-to-connect fittings 40, 42 further include a release mechanism 74, that when depressed, releases the gripping ring 70 to allow the hose to be removed. The release mechanism 74 of the push-to-connect fittings 40, 42 thus allows for a quick disconnection of the hose, which is otherwise firmly-secured by the gripping ring 70. A preferred fitting is a ¼" nickel-plated Legris Carstick® fitting made by Legris, Inc.

The oiling check valves 48 each contain a locking ring 76 to lock the oiling valve within the housings 14, 16. The oiling check valves 48 include a check ball 78 and a spring 80 to bias the check ball 78 against a check valve seat 82. Pressure from the oil against the check ball 78 accumulates until it exceeds an opposing bias force from the spring 80, at which point the spring 80 compresses and unseats the check ball 78 to permit oil to flow around the check ball 78 in a first direction 84 through the oiling check valves 48 and through the outlet housings 14, 16. The oiling check valves 48 prevent oil flow backward, or around the check ball 78 in a direction opposite to the flow path 84. In this manner, fuel from the fuel system is prevented from entering the oil distribution system 10. The bias force associated with spring 52 is preferably 10–18 p.s.i.

Upon biasing the check ball 78 of the oiling check valve 48 within the fuel system oiling outlet housing 16, the oil and air are free to flow to a predetermined location in the fuel system. The interior of the centrally-located dome 38 further includes a D-shaped wall that concentrates the pressurized oil entering the centrally-located dome 38 to each of the oil passages 64 of the cylinder outlet housings 14 and the passage 62 in outlet housing 16.

Figure 8:
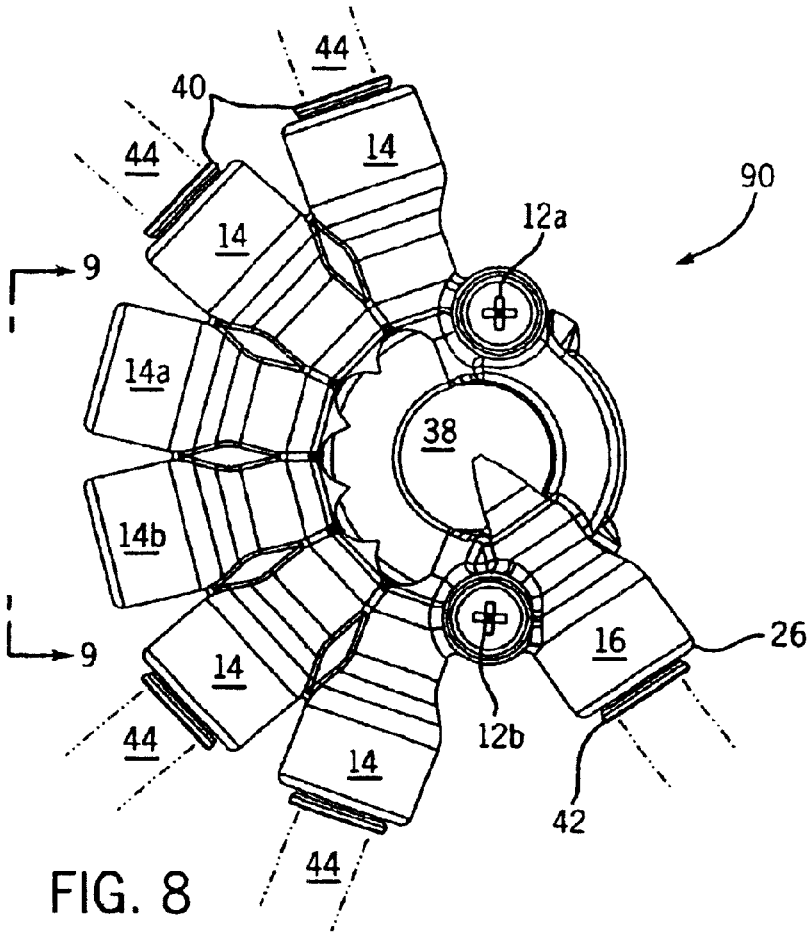
FIG. 8 is a top view of an alternate embodiment of the distribution manifold shown in FIG. 1.

An alternate embodiment of the present invention is shown in FIG. 8. A distribution manifold 90 having six cylinder outlet housings 14 is designed and constructed for use with a four cylinder internal combustion engine. The fuel system oiling outlet housing 16, as well as four of the cylinder outlet housings 14, each contain a push-to-connect fitting 40, 42 in a manner heretofore disclosed. The two remaining cylinder outlet housings 14*a,* 14*b* are mold with a D-shaped plug 62, best viewed in FIG. 9, to thereby prevent insertion of a push-to-connect fitting 40, as well as, any hose. The D-shaped plug 62 has a flat portion 62*a* that prevents a hose, a push-to-connect fitting, or an oiling check valve 48 within cylinder outlet housing 14*a,* 14*b.*

Figure 9:
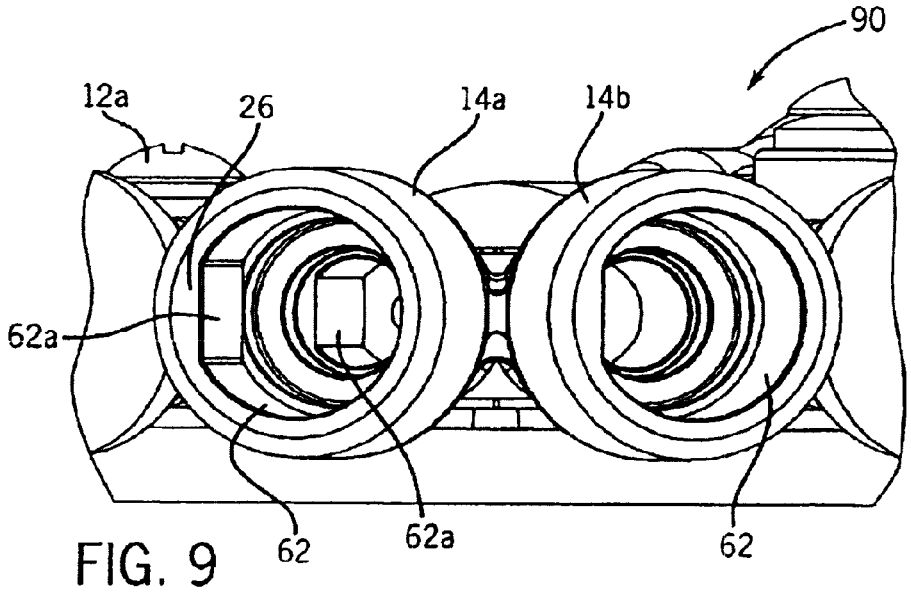
FIG. 9 is a front view of a portion of the distribution manifold of FIG. 8 taken along line 9—9 of FIG. 8.
Figure 10:
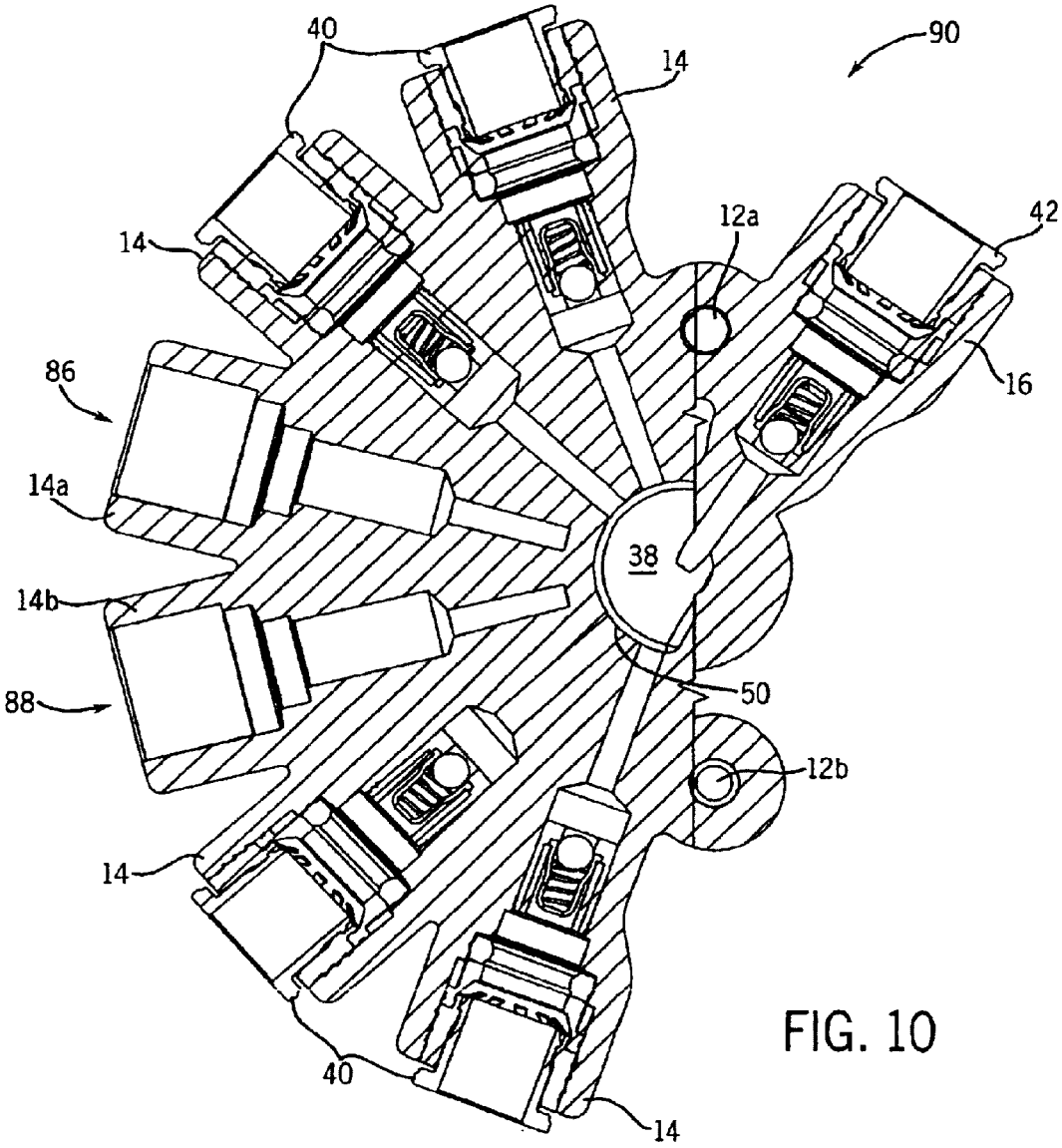
FIG. 10 is a cross-sectional top view of the distribution manifold shown in FIG. 8.

An enlarged sectional view of the distribution manifold 12*a* of FIGS. 8 and 9 is shown in FIG. 10. To ensure that engine oil is not distributed to the two cylinder outlet housings 14*a,* 14*b,* shorter molding plugs are used during molding so that bores 86 and 88 are not in fluid communication with the centrally-located dome 38. The two cylinder outlet housings 14*a,* 14*b* are thus isolated from the centrally-located dome 38. The four remaining cylinder outlet housings 14 are configured in a manner similar to that previously disclosed.

The present invention contemplates the use of an oil distribution manifold 12, 90 with a two-stroke internal combustion engine. One such application is a distribution manifold 12 for a two-stroke gasoline outboard marine engine, as shown in FIG. 1 for use with a six cylinder engine. However, it will be appreciated by those skilled in the art that the above-described invention is equally suited for use with other types of engines. The distribution manifold 12 designed for use with a six cylinder internal combustion engine includes six cylinder oiling outlet housings 14 having an oiling check valve 48 therein to regulate the flow of pressurized engine oil to each cylinder of the internal combustion engine. The distribution manifold 12 further includes a fuel system oiling outlet housing 16 having an oiling check valve 48 that regulates the flow of engine oil to the fuel system of the internal combustion engine and also allows the bleeding of any air in the oil system through the fuel separator. Each cylinder housing 14,16 is in fluid communication with a centrally-located dome 38 that is configured to concentrate the pressurized engine oil for distribution to the plurality of outlets. To facilitate the transport of air to the fuel system oiling outlet housing 16, a notch 58 extends along the upper interior surface of the centrally-located dome 38. The notch 58 is in fluid communication with the fuel system oiling outlet housing 16 at a position axially above the cylinder outlet housings 14.

The distribution manifold 90 is also constructed for use with a four cylinder internal combustion engine. The cylinder outlet housings 14*a,* 14*b* are molded with internal D-shaped plugs 62 such that a fitting a hose, or an oiling check valve cannot be inserted therein. To inhibit the flow of engine oil from the centrally-located dome 38 to cylinder outlet housings 14*a,* 14*b* are not molded to connect to the centrally-located dome 38. Thus, pressurized engine oil is not distributed to outlet housings 14*a,* 14*b.* Although the description of the present invention has been limited to the distribution of engine oil to an internal combustion engine, it is to be understood that the present invention is not limited to the distribution of any particular type of fluid.

The present invention has been described in terms of the preferred embodiment, and it is recognized that equivalents, alternatives, and modifications, aside from those expressly stated, are possible and within the scope of the appending claims.

What is claimed is:

1. An oil distribution manifold for use with an internal combustion engine comprising:

(A) a plurality of cylinder oiling outlet housings having therein a number of cylinder oiling valves, the number of which corresponds to a number of cylinders in the internal combustion engine, and (B) a fuel system oiling outlet housing having therein a fuel system oiling valve.

2. The oil distribution manifold of claim 1 wherein the number of cylinder outlet housings are in fluid communication with a centrally located dome.

3. The oil distribution manifold of claim 2 wherein the centrally located dome further comprises a notch extending along an upper interior surface of the centrally located dome, wherein the notch is in fluid communication with the fuel system oiling outlet valve to purge air therethrough.

4. The oil distribution manifold of claim 3 wherein the fuel system oiling outlet housing extends outwardly from the centrally located dome and is at an elevation higher than the plurality of cylinder oiling outlet housings.

5. The oil distribution manifold of claim 2 wherein the internal combustion is a two-stroke engine configured for use in an outboard marine engine.

6. The oil distribution manifold of claim 3 wherein each cylinder oiling valve further comprises a check valve therein to regulate the flow of pressurized oil to the cylinders of the internal combustion engine, wherein the check valves are in fluid communication with the centrally located dome.

7. The oil distribution manifold of claim 6 wherein the check valve comprises a valve seat and a spring to bias the check ball against the valve seat at approximately 10–18 p.s.i.

8. The oil distribution manifold of claim 1 wherein the fuel system oiling outlet housing is positioned at a height axially above the plurality of cylinder oiling outlet housings.

9. The oil distribution manifold of claim 1 wherein the number of oiling valves is equal to the number of cylinders in the internal combustion engine and wherein the plurality of cylinder oiling outlet housings exceed the number of the cylinder oiling valves.

10. The oil distribution manifold of claim 1 wherein the plurality of cylinder oiling outlet housings further comprise a push-to-connect fitting to engage an oil line therein.

11. The oil distribution manifold of claim 1 further comprising an oil inlet in fluid communication within a pressurized oil source, the oil inlet having a D-shape to concentrate pressurized oil to each of the cylinder oiling valves and the fuel system oiling valve.

12. The oil distribution manifold of claim 1 wherein each of the plurality of cylinder oiling outlet housings are equidistant from one another.

13. The oil distribution manifold of claim 12 wherein the fuel system oiling valve is at a higher elevation than each of the number of cylinder oiling valves.

14. The oil distribution manifold of claim 1 constructed according to the steps of:

molding the distribution manifold with N cylinder oiling outlet housings and a centrally located oil chamber; and molding a number of passages in the cylinder oiling outlet housing to the centrally-located oil chamber, where the number of passages is equal to N if a number of cylinders of an engine is equal to N, and where the number of passages is M if the number of cylinders is equal to M, where M is less than N.

15. The method of claim 14 further comprising the step of using a shorter molding plug in N–M cylinder oiling outlet housings if the number of cylinders is equal to M.

16. The method of claim 14 further comprising the step of using an offset molding plug to form a D-shape plug in N–M cylinder oiling outlet housings if the number of cylinders is equal to M.

17. An oil distribution manifold comprising:

a centrally located chamber connected to receive pressurized oil, the centrally located chamber having a plurality of cylinder outlet ports and a fuel system outlet port wherein the fuel system outlet port is at an elevation higher than the cylinder outlet ports;

a plurality of cylinder outlets in fluid communication within the plurality of cylinder outlet ports; and a fuel system outlet in fluid communication with the fuel system outlet port.

18. The oil distribution manifold of claim 17 further comprising a check valve in each of the plurality of cylinder outlets and the fuel system outlet.

19. The oil distribution manifold of claim 17 wherein the centrally located chamber is dome-shaped to accumulate and purge air through the fuel system outlet port thereby preventing air from entering the plurality of cylinder outlets.

20. The oil distribution manifold system of claim 19 further comprising a notch extending along an upper interior surface of the centrally located chamber wherein the notch is in fluid communication with the fuel system outlet port to purge air therethrough.

21. The oil distribution manifold of claim 17 constructed for use on various engine configuration such that a number of cylinder outlets are formed ineffective.

22. The oil distribution manifold of claim 17 wherein a number of the plurality of cylinder outlet ports are fluidly isolated from the centrally located chamber.

23. The oil distribution manifold of claim 17 wherein the plurality of cylinder outlets further comprise a push-to-connect fitting to engage an oil line therein.

24. An oiling system for a two-stroke outboard marine engine comprising:

an oil system housing having an oil inlet, and an oil outlet;

a manifold mounted to the oiling system housing in fluid communication with the oil outlet, the manifold having a plurality of cylinder oiling outlet housings and a fuel system oiling outlet housing; and a solenoid mounted to the oil system housing to control oil flow to the manifold.

25. The oil system of claim 24 further comprising a replaceable oil filter mounted to the oil system housing.

26. The oiling system of claim 24 wherein the plurality of cylinder oiling outlet housings are in fluid communication with a centrally located dome.

27. The oiling system of claim 26 wherein the centrally located dome further comprises a notch extending along an upper interior surface of the centrally located dome, wherein the notch is in fluid communication with the fuel system oiling outlet housing to purge air therethrough.

28. The oiling system of claim 26 wherein the fuel system oiling outlet housing extends outwardly from the centrally located dome and is at an elevation higher than the plurality of cylinder oiling outlet housings.

29. The oiling system of claim 24 wherein the fuel system oiling outlet housing is positioned at a height axially above the plurality of cylinder oiling outlet housings.

30. The oiling system of claim 24 wherein each of the plurality of cylinder oiling outlet housings are equidistant from one another.

31. The oiling system of claim 30 wherein each of the plurality of cylinder oiling outlet housings are positioned about the centrally located dome 28 degrees from one another.

32. A method of bleeding air from an oil system of an internal combustion engine comprising the steps of:

providing an oil system;

providing an oil outlet port for each cylinder of an engine and an oil outlet port for a fuel system of the engine;

positioning the outlet port for the fuel system at a higher elevation than each of the oil outlet ports for each cylinder;

connecting the outlet port for the fuel system to a fuel separator in the fuel system; and wherein air in the oil system bleeds through the outlet port for the fuel system and is purged through the fuel separator.

* * * * *